US007461709B2

(12) United States Patent
Keshavan et al.

(10) Patent No.: US 7,461,709 B2
(45) Date of Patent: Dec. 9, 2008

(54) MULTIPLE DIAMETER CUTTING ELEMENTS AND BITS INCORPORATING THE SAME

(75) Inventors: Madapusi K. Keshavan, The Woodlands, TX (US); Michael G. Azar, The Woodlands, TX (US); David K. Truax, Houston, TX (US)

(73) Assignee: Smith International, Inc., Houston, TX (US)

( * ) Notice: Subject to any disclaimer, the term of this patent is extended or adjusted under 35 U.S.C. 154(b) by 58 days.

(21) Appl. No.: 10/919,906

(22) Filed: Aug. 17, 2004

(65) Prior Publication Data

US 2005/0082093 A1 Apr. 21, 2005

Related U.S. Application Data

(60) Provisional application No. 60/496,847, filed on Aug. 21, 2003.

(51) Int. Cl.
*E21B 10/56* (2006.01)

(52) U.S. Cl. ..... 175/428

(58) Field of Classification Search ..... 175/426–433
See application file for complete search history.

(56) References Cited

U.S. PATENT DOCUMENTS

| | | | | |
|---|---|---|---|---|
| 4,593,777 A | | 6/1986 | Barr | |
| 4,724,913 A | | 2/1988 | Morris | |
| 4,861,350 A | * | 8/1989 | Phaal et al. | 175/426 |
| 4,911,254 A | | 3/1990 | Keith | |
| 5,383,527 A | | 1/1995 | Azar | |
| 5,429,199 A | | 7/1995 | Sheirer et al. | |
| 5,467,837 A | | 11/1995 | Miller et al. | |
| 5,533,582 A | | 7/1996 | Tibbitts | |
| 5,549,171 A | | 8/1996 | Mensa-Wilmot et al. | |
| 5,649,604 A | | 7/1997 | Fuller et al. | |
| 5,740,874 A | | 4/1998 | Matthias | |
| 5,839,526 A | * | 11/1998 | Cisneros et al. | 175/431 |
| 5,881,828 A | * | 3/1999 | Fischer et al. | 175/430 |
| 5,967,245 A | * | 10/1999 | Garcia et al. | 175/431 |
| 6,009,963 A | | 1/2000 | Chaves et al. | |
| 6,065,554 A | | 5/2000 | Taylor et al. | |
| 6,164,394 A | | 12/2000 | Mensa-Wilmot et al. | |
| 6,199,645 B1 | * | 3/2001 | Anderson et al. | 175/426 |
| 6,302,223 B1 | | 10/2001 | Sinor | |
| 6,929,079 B2 | * | 8/2005 | McDonough et al. | 175/430 |
| 7,152,703 B2 | * | 12/2006 | Meiners et al. | 175/426 |

FOREIGN PATENT DOCUMENTS

| | | |
|---|---|---|
| EP | 0 741 228 A3 | 11/1996 |
| GB | 2 330 599 A | 4/1999 |
| GB | 2 353 550 A | 2/2001 |

* cited by examiner

*Primary Examiner*—Richard E. Chilcot, Jr.
*Assistant Examiner*—Matt J Smith
(74) *Attorney, Agent, or Firm*—Christie, Parker & Hale, LLP

(57) ABSTRACT

Cutting elements are provided having multiple diameter sections. Also provided are bits incorporating such cutting elements.

52 Claims, 6 Drawing Sheets

MULTIPLE DIAMETER CUTTING ELEMENTS AND BITS INCORPORATING THE SAME

CROSS-REFERENCE TO RELATED APPLICATION

This application is based upon and claims priority upon U.S. Provisional Application No. 60/496, 847, filed on Aug. 21, 2003, the contents of which are fully incorporated herein by reference.

BACKGROUND OF THE INVENTION

This invention relates to cutting elements for use in rock bits and more specifically to cutting elements which include multiple diameter sections and to bits incorporating the same.

A cutting element, as for example a shear cutter as shown in FIG. 1, typically has a cylindrical cemented tungsten carbide body 10. The cylindrical body has a face forming an interface surface 12. An ultra hard material cutting layer 14 is formed over the interface surface 12. The ultra hard material layer is typically a polycrystalline diamond or polycrystalline cubic boron nitride layer. The ultra hard material layer typically has a planar upper surface 16 or a dome-shaped upper surface (not shown).

Shear cutters are generally mounted in pre-formed pockets 22 on a bit body 18 at a rake angle 20 typically in the order of 10°-20° (FIGS. 2 and 3). Each pocket has a rear support wall 23 which is a cylindrical section having a diameter slightly greater than the diameter of the cutter body. Typically a 90°-180° portion 24 of the cylindrical body outer surface 25 is brazed on the rear support wall. During drilling, the portion 27 of the cutting layer opposite the brazed area 26 is subjected to high impact loads which often lead to crack formations on the cutting layer as well as the delamination of the cutting layer from the cutter body. Moreover, these high impact loads tend to speed up the wear of the cutting layer. The component 138 of the impact load which is normal to the formations being drilled is a severe load because it is also reacting the weight of the bit body as well as the drill string. A majority of this load is reacted in shear along the interface between the cutting layer and the cutter body. This shear force promotes the delamination of the cutting layer from the cutter body.

To improve the fatigue, wear and impact resistance of the ultra hard material layer, i.e., the cutting layer, as well as to improve the ultra hard material layer's delamination resistance, it is common to increase the thickness of the ultra hard material layer, i.e., increase the volume of the material subject to impact during drilling. However, the increase in the thickness of the ultra hard material results in an increase in the magnitude of the residual stresses formed on the interface between the ultra hard material and the cutting element body which may result in early failure of the cutting element. Consequently, cutting elements are desired having improved ultra hard material layer fatigue, wear and impact strength, as well as improved delamination resistance.

SUMMARY OF THE INVENTION

Multiple diameter cutting elements and bits incorporating the same are provided. In one exemplary embodiment, a cutting element is provided having a body including a longitudinal axis and a periphery having at least two single curvature sections, each section having a single radius of curvature along a plane generally perpendicular to the longitudinal axis, where each section has a different radius of curvature from an adjacent section. The single curvature sections define the entire periphery. An ultra hard material layer is formed over the body. The ultra hard material layer has a periphery which includes at least two single curvature sections along a plane generally perpendicular to the longitudinal axis.

In another exemplary embodiment, the body and the ultra hard material layer peripheries each include three single curvature sections such that each body periphery section abuts two adjacent body periphery sections and each of the ultra hard material periphery sections abuts two adjacent ultra hard material periphery sections. In another exemplary embodiment, each section has a different radius of curvature than an abutting section. In a further exemplary embodiment two abutting sections have the same radius of curvature.

In yet a further exemplary embodiment, the body and the ultra hard material layer peripheries each consist of two sections, where two body periphery sections abut each other and where the two ultra hard material layer periphery sections abut each other. In another exemplary embodiment, each ultra hard material periphery section is aligned with a corresponding body periphery section and corresponding ultra hard material periphery and body periphery sections have the same radius of curvature. In a further exemplary embodiment, the ultra hard material sections define the entire periphery of the ultra hard material layer. In yet a further exemplary embodiment, each of the body and ultra hard material layer peripheries have at least two but no more than three single curvature sections along a plane generally perpendicular to the longitudinal axis.

In another exemplary embodiment, a bit is provided on which is mounted any of the aforementioned exemplary embodiment cutting elements. In yet a further exemplary embodiment, a bit body is provided having a first pocket having a diameter and a second pocket having a diameter that is the same as the diameter of the first pocket. A first cutting element is mounted on the first pocket. The first cutting element has a body and a cutting layer each having a first diameter portion and a second diameter portion. The second diameter portions have diameters different from the diameters of the first diameter portions. The body first diameter portion is brazed to the first pocket. A second cutting element is mounted on the second pocket. The second cutting element has a body and a cutting layer each having a first diameter portion and a second diameter portion. The second cutting element second diameter portions have diameters different from the diameters of the second cutting element first diameter portions. The second cutting element body first diameter portion is brazed to the second pocket, and the diameter of the second diameter portion of the second cutting element is greater than the second diameter portion of the first cutting element. In another exemplary embodiment, the first cutting element second diameter portions have diameters greater than the first cutting element first diameter portions. In a further exemplary embodiment, the second cutting element second diameter portions have diameters greater than the second cutting element first diameter portions.

In another exemplary embodiment, a bit body is provided having a first pocket having a diameter and a second pocket having a diameter that is the same as the diameter of the first pocket. A first cutting element is mounted on the first pocket, and a second cutting element mounted on the second pocket. Each cutting element has a curved surface for contacting earth formations during drilling, and the curved surface of the first cutting element has a diameter that is different from the diameter of the curved surface of the second cutting element.

In yet a further exemplary embodiment, a bit body is provided having a first pocket having a diameter and a second pocket having a diameter that is different from the diameter of the first pocket. A first cutting element is mounted on the first pocket, and a second cutting element is mounted on the second pocket. Each cutting element has a curved surface for contacting earth formations during drilling. The curved surface of the first cutting element has a diameter that is the same as the diameter of the curved surface of the second cutting element.

In another exemplary embodiment, a bit body is provided having a first pocket having a diameter, and a second pocket having a diameter that is different from the diameter of the first pocket. A first cutting element is mounted on the first pocket. The first cutting element has a body and a cutting layer each having a first diameter portion and a second diameter portion. The second diameter portions of the first cutting element have diameters different from the diameters of the first diameter portions. The first cutting element body first diameter portion is brazed to the first pocket. A second cutting element is mounted on the second pocket. The second cutting element has a body and a cutting layer each having a first diameter portion and a second diameter portion. The second cutting element second diameter portions have diameters different from the diameters of the second cutting element first diameter portions. The second cutting element body first diameter portion is brazed to the second pocket. The diameter of the second diameter portion of the second cutting element is the same as the diameter of the second diameter portion of the first cutting element.

In yet a further exemplary embodiment a bit body is provided having a first pocket having a diameter and a second pocket having a diameter that is different from the diameter of the first pocket. A first cutting element is mounted on the first pocket. A second cutting element is mounted on the second pocket. Each cutting element has a curved surface for contacting earth formations during drilling. The curved surface of the first cutting element has a diameter that is different from a diameter of the curved surface of the second cutting element, and the difference between the diameters of the two pockets is different from the difference of the diameters of the two curved surfaces. In one exemplary embodiment, the difference between the diameters of the two pockets is greater than the difference of the diameters of the two curved surfaces, while in another exemplary embodiment, the difference between the diameters of the two pockets is less than the difference of the diameters of the two curved surfaces.

In yet another exemplary embodiment, a bit body is provided having a first pocket having a diameter and a second pocket having a diameter that is different from the diameter of the first pocket. A first cutting element is mounted on the first pocket. The first cutting element has a body and a cutting layer each having a first diameter portion and a second diameter portion. The second diameter portions of the first cutting element have diameters different from the diameters of the first diameter portions. The first cutting element body first diameter portion is brazed to the first pocket. A second cutting element is mounted on the second pocket. The second cutting element has a body and a cutting layer each having a first diameter portion and a second diameter portion. The second cutting element second diameter portions have diameters different from the diameters of the second cutting element first diameter portions. The second cutting element body first diameter portion is brazed to the second pocket. The diameter of the second diameter portion of the second cutting element is different from the diameter of the second diameter portion of the first cutting element. In one exemplary embodiment, the difference between the diameters of the first and second pockets is greater than the difference between the diameter of the second diameter portion of the second cutting element and the diameter of the second diameter portion of the first cutting element. In another exemplary embodiment, the difference between the diameters of the first and second pockets is less than the difference between the diameter of the second diameter portion of the second cutting element and the diameter of the second diameter portion of the first cutting element.

DETAILED DESCRIPTION OF THE INVENTION

This invention provides multiple diameter cutting elements and bits incorporating the same. Multiple diameter cutting elements are cutting elements whose periphery is composed of sections in cross-section (i.e., along a plane generally perpendicular to a longitudinal axis of the cutting elements), where abutting sections have different diameters (i.e., a different radii of curvature). It should be noted that the term "diameter" as used herein when referring to the diameter of a section or a pocket which forms only part of a cylinder or circle, refers to the diameter of such section or pocket if such section or pocket formed a complete cylinder or circle.

Figure 1:
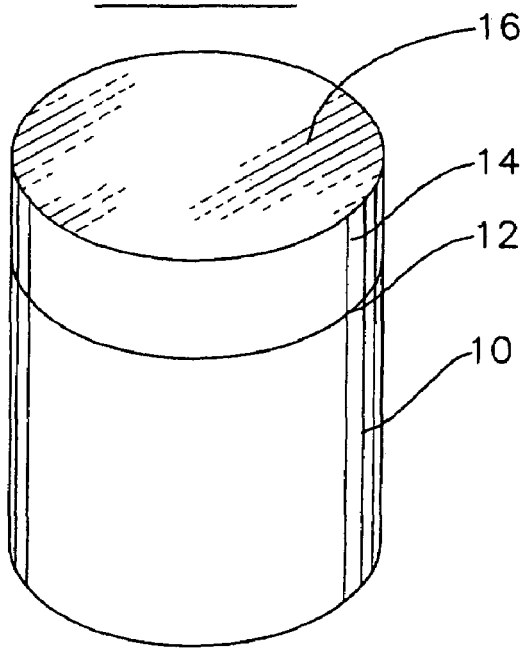
FIG. 1 PRIOR ART
FIG. 1 is a perspective view of a conventional cutting element.
Figure 3:
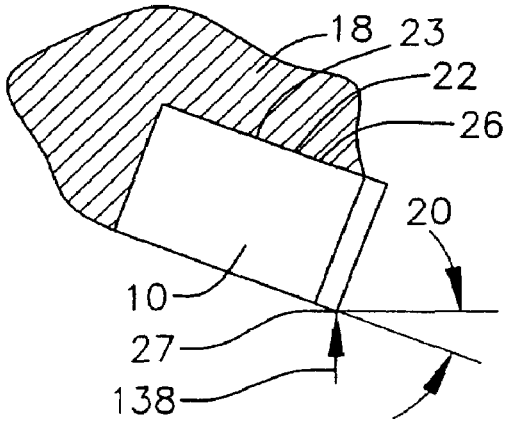
FIG. 3 PRIOR ART
FIG. 3 is a partial cross-sectional view of the bit body and cutting element shown in FIG. 2 taken along arrows 3-3.
Figure 4:
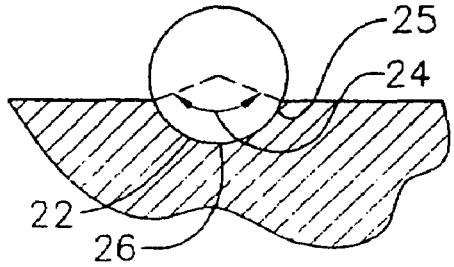
FIG. 4 PRIOR ART
FIG. 4 is an end view of the bit body of the cutting element shown in FIG. 2 taken along arrows 4-4.
Figure 2:
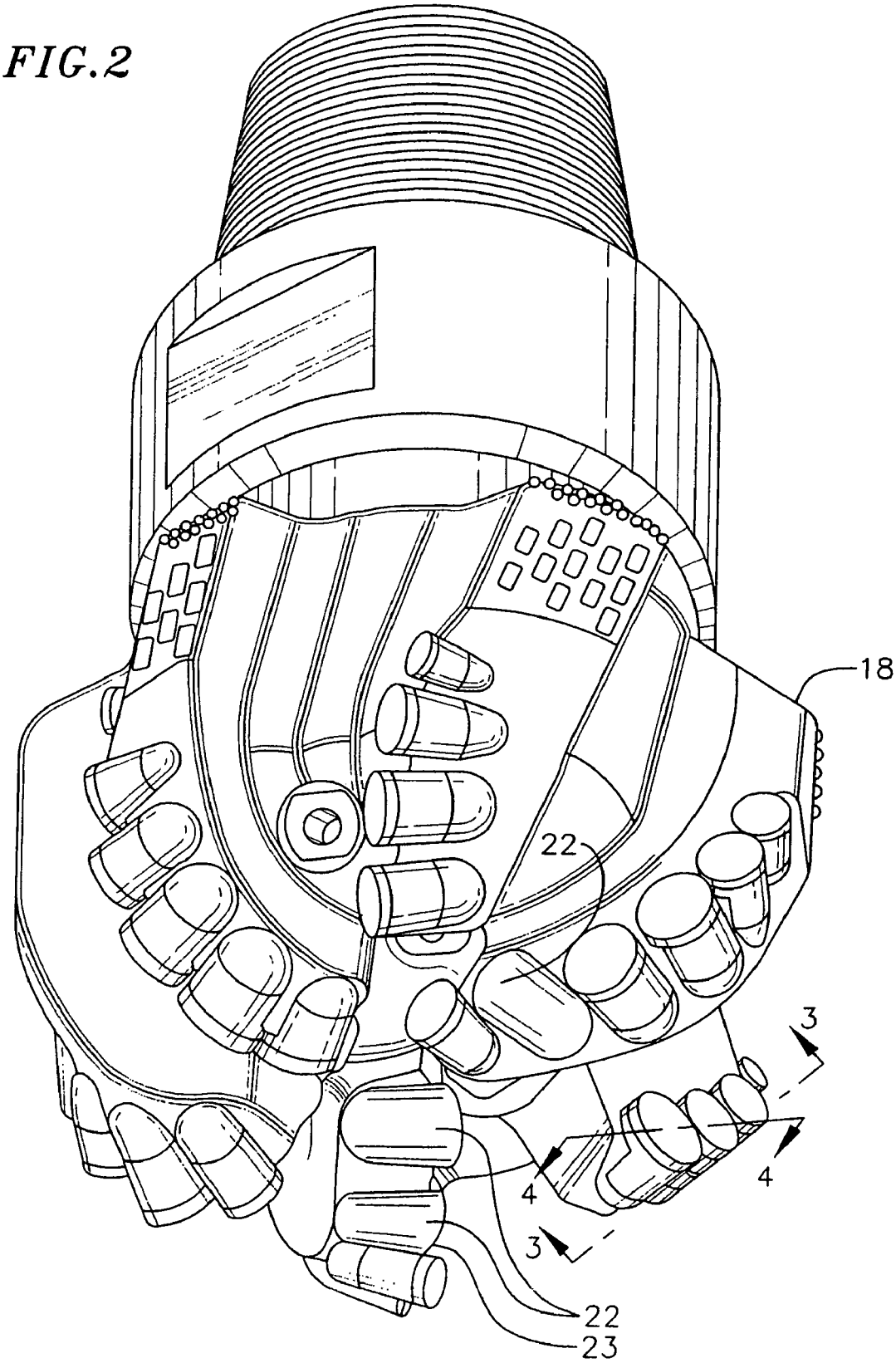
FIG. 2 is a perspective view of a bit body having cutting elements mounted thereon.
Figure 5:
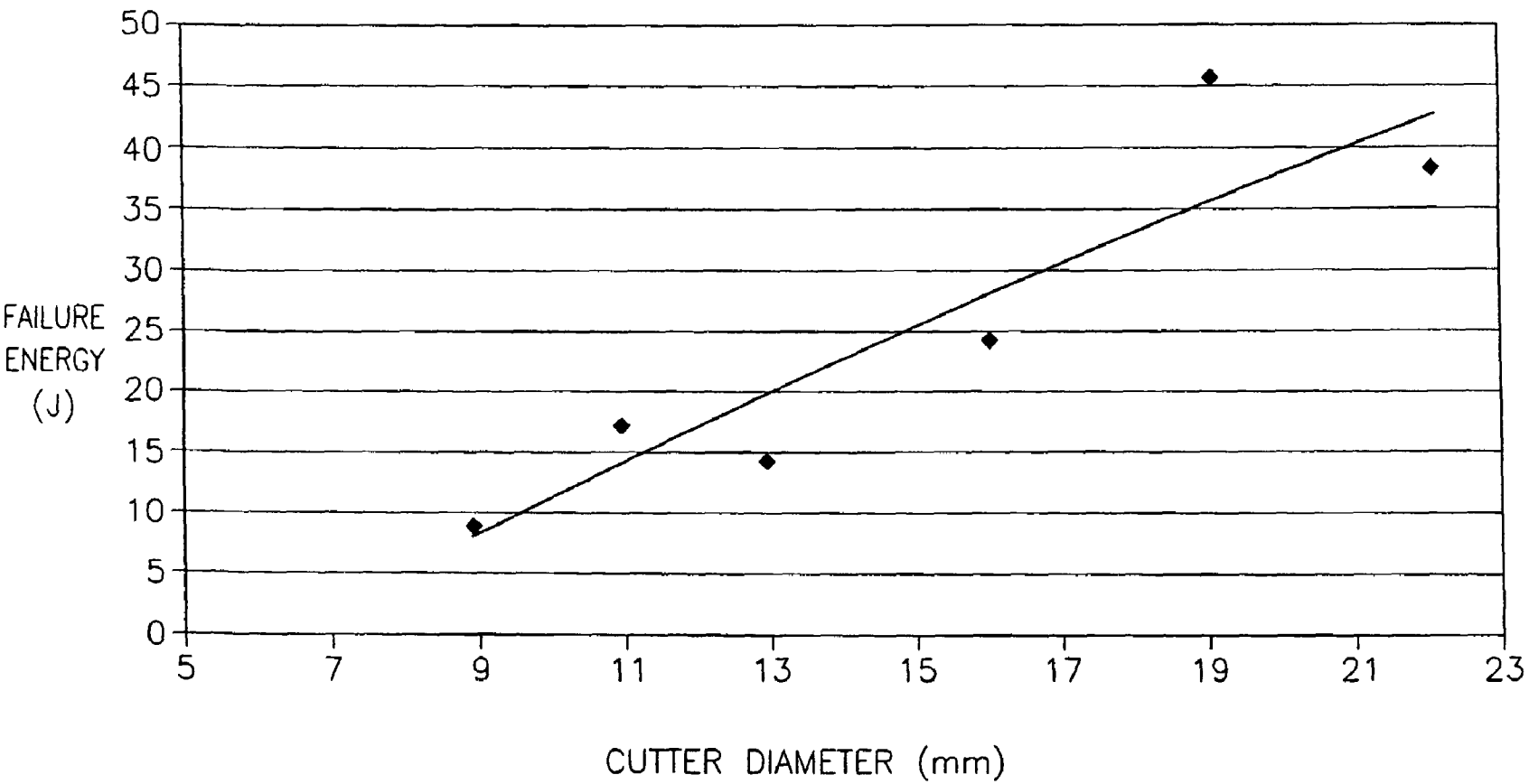
FIG. 5 is a graph of impact failure energy versus cutting element diameter.

Applicants have discovered that the impact strength of a cutting element, and more specifically the impact strength of the ultra hard material cutting layer of a cutting element increases as the diameter of the ultra hard material cutting layer making contact with the earth formations increases. This can be evidenced from the graph shown in FIG. 5 depicting cutting element diameter versus impact failure energy, i.e., the energy needed for impact failure. Impact energy is proportional to impact strength.

Thus, one way to improve the impact strength of a cutting element is to increase the diameter of the cutting element. Larger diameter cutting elements tend to be more expensive to manufacture. Moreover, larger diameter cutting elements cannot be accommodated in existing bit bodies which are preformed with conventional smaller diameter pockets. As such, to accommodate larger diameter cutting elements, a bit body would have to be formed with larger diameter pockets or the pockets existing in a bit body would have to be machined to form larger diameter pockets. This can be expensive and can also be detrimental to the strength of the bit body.

Figure 7:
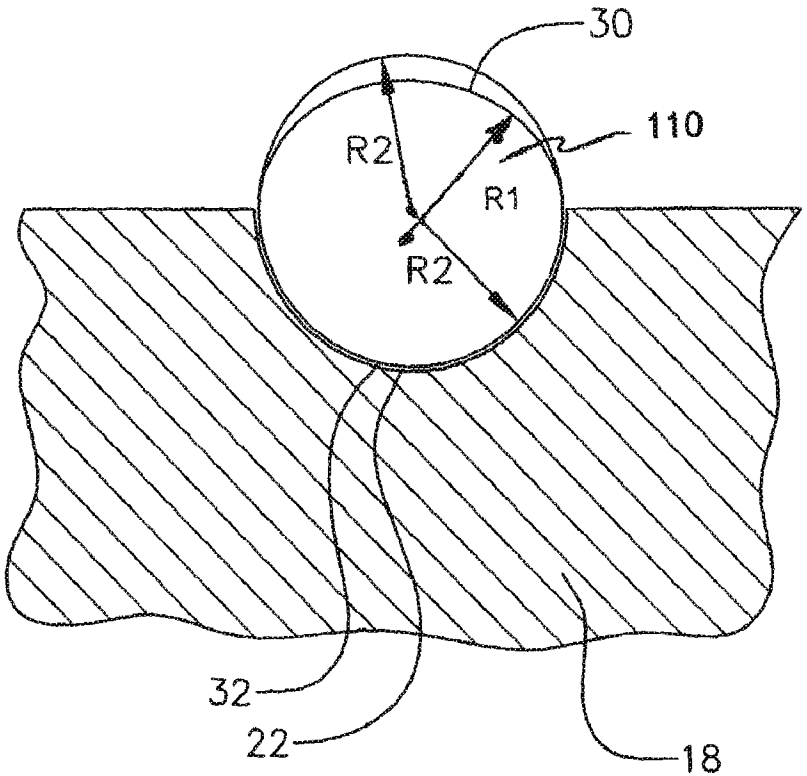
FIG. 7 is a cross-sectional view of an exemplary embodiment cutting element of the present invention mounted on a bit body.
Figure 6:
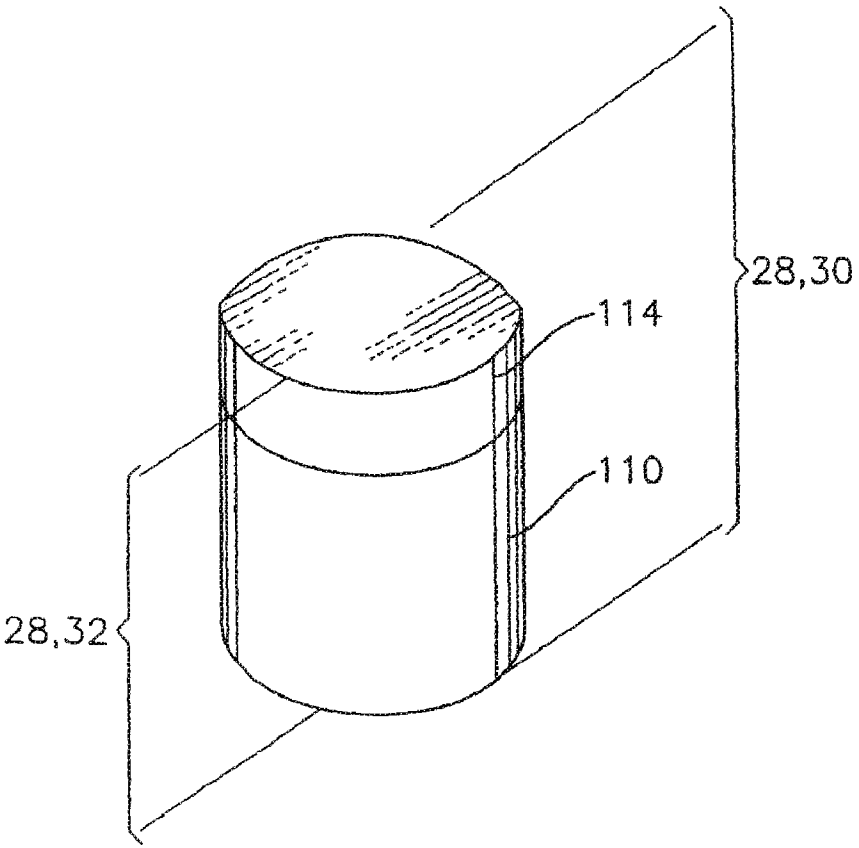
FIG. 6 is a perspective view of an exemplary embodiment cutting element of the present invention.

The inventive multiple diameter cutting elements can be incorporated in existing bit bodies incorporating conventional smaller diameter pockets, while providing larger diameter cutting layer sections for cutting earth formations. The inventive cutting elements, in an exemplary embodiment, have two or three diameter (i.e., radii) sections 28, i.e., two or three sections having different radii of curvature and together spanning the entire periphery of the cutting elements, where each section 28 extends across the thickness of the cutting layer 114 and across the thickness of the substrate body 110, as for example shown in FIG. 6. In one exemplary embodiment as shown in FIGS. 6 and 7, a cutting element is provided having two diameter sections. A larger diameter section 30 having a radius R1 and a smaller diameter section 32 having a radius R2. The smaller diameter section is chosen such that it could fit and be brazed into the existing pockets 22 of the bit body 18. The larger diameter section 30 is a section that extends opposite a bit pocket, when the cutting element in mounted in the pocket, as for example shown in FIGS. 6 and 7. In this regard, the section of the cutting element and specifically the ultra hard material layer making contact with the earth formation during drilling is the larger diameter section 30 of the cutting element. Since the larger diameter section 30 of the cutting layer will make contact with the earth formations during drilling, the impact strength of the cutting element is improved.

Exemplary embodiment cutting elements can have a larger diameter of 22 mm having radius R1 and a smaller diameter section of 19 mm having radius R2. In another exemplary embodiment, the larger diameter section with radius R1 may have a 19 mm diameter and the smaller diameter section with radius R2 may have a 16 mm diameter.

Figure 8:
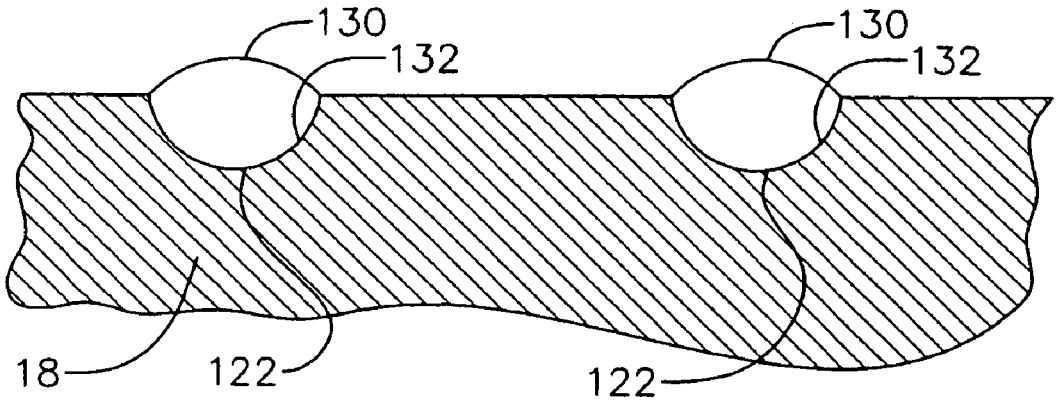
FIG. 8 is an end view of two exemplary embodiment cutting elements mounted on a bit body.
Figure 9:
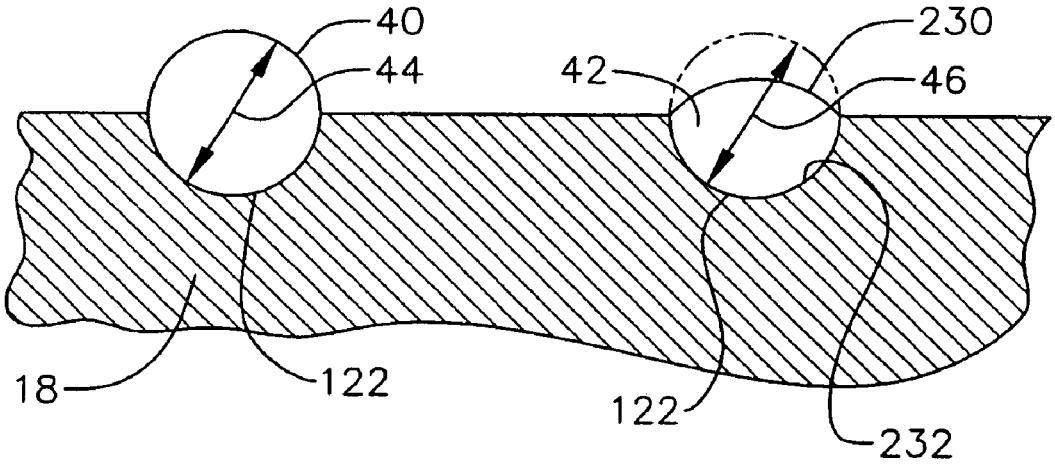
FIG. 9 is an end view of an exemplary embodiment cutting element mounted on a bit body and of a conventional cutting element mounted on a bit body.

With the present invention, for each cutting element mounted on a predetermined diameter bit body pocket, the diameter or the radius of curvature of a cutting element cutting layer portion making contact with the earth formation may be increased or otherwise varied or tailored, for improving the cutting element impact strength. For example, in two identical diameter pockets of a bit body 122 as for example shown in FIG. 8, there may be mounted two cutting elements each having two sections, a first section 130 and a second section 132, where both cutting elements have the same diameter second sections 132 and the same or different diameter first sections 130. With these exemplary embodiments, the first sections may have a diameter greater than the second sections and the diameter of the second sections 132 is slightly smaller than the diameter of the pockets 122 so that each cutting element 42 second section body portion can be accepted and brazed to its corresponding pocket. In another exemplary embodiment, a cylindrical cutting element 40 is mounted in a first pocket 122 and a dual diameter cutting element having a larger diameter section 230 and a smaller diameter section 232 is mounted in second pocket where both pockets have the same diameter and where the diameter 44 of the cylindrical cutting element is the same as the diameter 46 of the smaller diameter section 232 of the dual diameter cutting element 42. The smaller diameter section and the cylindrical cutting element diameters 44, 46 are slightly smaller than the diameter of the pockets so that their corresponding body sections can be brazed to the first and second pockets, respectively.

Figure 10:
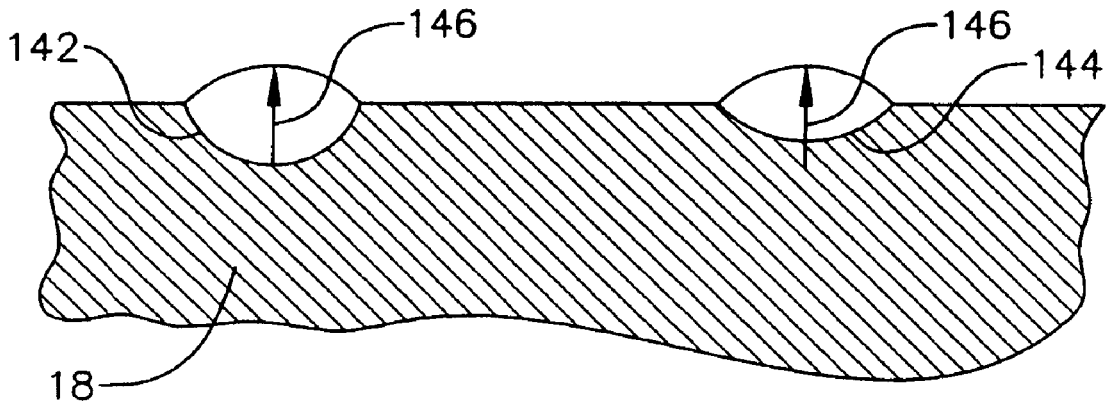
FIG. 10 is an end view of two other exemplary embodiment cutting elements mounted on a bit body.
Figure 11:
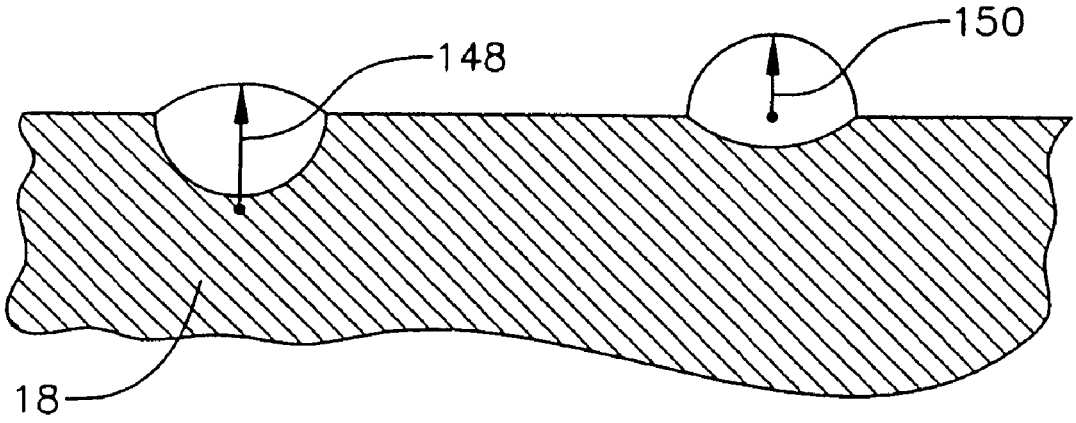
FIG. 11 is an end view of two further exemplary embodiment cutting elements mounted on a bit body.

In other exemplary embodiments, multiple diameter cutting elements may be mounted on bit pockets having different diameters as for example pockets 142, 144, shown in FIG. 10. In one exemplary embodiment, the cutting sections, i.e., the sections that contact the earth formations during drilling, of the cutting elements mounted on such different diameter pockets have the same diameter, i.e., the same radius of curvature 146. In another exemplary embodiment, the cutting sections have different diameters, i.e., radii of curvature 148 and 150, respectively, which may be tailored for the cutting at hand, as for example shown in FIG. 11. In the later embodiment the difference between the diameters of two pockets and the difference between the diameters of the cutting sections of two cutting elements mounted on such pockets may not be equal.

In other exemplary embodiments, the exemplary embodiment cutting elements may be mounted on a bit body with their larger diameter section body portions brazed to the bit body pockets.

Figure 12:
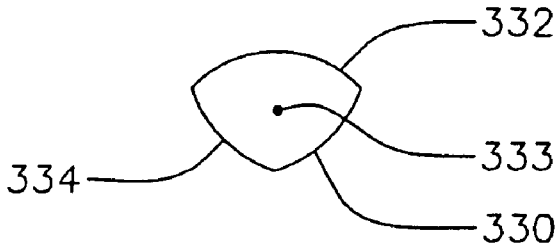
FIG. 12 is an end view of another exemplary embodiment cutting element having three diameter sections.

In a further exemplary embodiment, a cutting element may be formed with three arcuately arranged and abutting sections 330, 332 and 334 as shown for example in FIG. 12, each section having a single diameter or a single radius of curvature in cross-section, i.e., along a plane generally perpendicular to a longitudinal axis 333 of the cutting element. These sections may span across the thickness of the cutting layer and the thickness of the substrate of each cutting element. In one exemplary embodiment, each section has a different diameter or radius of curvature from an adjacent section. In another exemplary embodiment, two sections have the same radius of curvature and one section has a different radius of curvature. The two sections with same radius of curvature may each have a radius of curvature that is greater or less than the radius of curvature of the third section.

In another exemplary embodiment, a cutting element is provided where the cutting element body, i.e., substrate, as well as the cutting layer, each comprise two or three abutting sections, each section having a single radius of curvature or diameter. In a further exemplary embodiment, the cutting element has two or three sections, each section extending through the entire cutting element cutting layer and substrate thickness. In this regard, the cutting element consists of two or three single radius or single diameter sections.

In one exemplary embodiment, cans having multiple diameter sections maybe used to form the exemplary embodiment cutting elements using well known methods such as high pressure, high temperature sintering methods. Some machining and/or cutting of the cutting elements may be necessary afterwards to obtain the appropriate diameter sections. In alternate embodiments, cylindrical cutting elements may be formed using conventional methods and then machined and/or cut to the appropriate multiple diameter sections. Machining and/or cutting may be performed by well known methods such as wire Electro Discharge Machining (EDM), and/or grinding. This latter method is typically preferred when forming cutting elements having more than two sections.

All examples and conditional language recited herein are intended to be only for pedagogical purposes and to aid in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and the functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

The invention claimed is:

1. A cutting element comprising:

a body comprising a longitudinal axis and an exposed periphery comprising at least two constant curvature sections extending along a length of the body, each section having a single radius of curvature along a first plane generally perpendicular to the longitudinal axis, wherein each section has a different radius of curvature from an adjacent section along said first plane, said constant curvature sections defining the entire periphery, wherein at least one of said constant curvature sections is for mating with a bit; and an ultra hard material layer formed over the body, the ultra hard material layer having a periphery, wherein the ultra hard material layer periphery comprises at least two constant curvature sections along a second plane generally perpendicular to the longitudinal axis.

2. A cutting element as recited in claim 1 wherein the body and the ultra hard material layer peripheries each comprise three constant curvature sections wherein each body periphery section abuts two adjacent body periphery sections and wherein each ultra hard material periphery section abuts two adjacent ultra hard material periphery sections.

3. A cutting element as recited in claim 2 wherein abutting sections have different radii of curvature.

4. A cutting element as recited in claim 3 wherein two sections have the same radius of curvature.

5. A cutting element as recited in claim 1 wherein the body and the ultra hard material layer peripheries each consist of two sections, wherein the two body periphery sections abut each other and wherein the two ultra hard material layer periphery sections abut each other.

6. A cutting element as recited in claim 1 wherein each ultra hard material periphery section is aligned with a corresponding body periphery section and wherein corresponding ultra hard material periphery and body periphery sections have the same radii of curvature.

7. A cutting element as recited in claim 1 wherein said ultra hard material sections define the entire periphery of the ultra hard material layer.

8. A cutting element as recited in claim 1 wherein each of said body and ultra hard material layer peripheries comprise at least two but no more than three constant curvature sections along a plane generally perpendicular to the longitudinal axis.

9. A cutting element as recited in claim 1 wherein all constant curvature sections of said ultra hard material layer have an equal thickness as measured longitudinally along the periphery of said ultra hard material layer.

10. A cutting element as recited in claim 1 wherein said exposed periphery has a length and wherein each of said at least two constant curvature sections extend along said entire length.

11. A bit comprising:

a body comprising, a first pocket having a diameter, and a second pocket having a diameter that is the same as the diameter of the first pocket;

a first cutting element mounted on the first pocket, the first cutting element having a body and a cutting layer each having a first diameter portion and a second diameter portion, wherein the second diameter portions have diameters different from the diameters of the first diameter portions, wherein the body first diameter portion is brazed to the first pocket; and a second cutting element mounted on the second pocket, the second cutting element having a body and a cutting layer each having a first diameter portion and a second diameter portion, wherein the second cutting element second diameter portions have diameters different from the diameters of the second cutting element first diameter portions, wherein the second cutting element body first diameter portion is brazed to the second pocket, and wherein the diameter of the second diameter portion of the second cutting element is greater than the diameter of the second diameter portion of the first cutting element.

12. The bit as recited in claim 11 wherein the first cutting element second diameter portions have diameters greater than the first cutting element first diameter portions.

13. The bit as recited in claim 12 wherein the second cutting element second diameter portions have diameters greater than the second cutting element first diameter portions.

14. A bit as recited in claim 11 wherein all first cutting element cutting layer diameter portions have an equal thickness as measured longitudinally along a periphery of said first cutting element cutting layer.

15. A bit as recited in claim 14 wherein all second cutting element cutting layer diameter portions have an equal thickness as measured longitudinally along a periphery of said second cutting element cutting layer.

16. A bit comprising:

a body comprising, a first pocket having a diameter, and a second pocket having a diameter that is the same as the diameter of the first pocket;

a first cutting element mounted on the first pocket; and a second cutting element mounted on the second pocket, wherein each cutting element comprises a curved surface for contacting earth formations during drilling, wherein the curved surface of the first cutting element has a diameter that is different from a diameter of the curved surface of the second cutting element.

17. A bit comprising:

a bit body having a pocket; and a cutting element having a longitudinal axis and mounted on the pocket, the cutting element comprising, a cutting element body comprising a periphery comprising at least two constant curvature sections along a first plane generally perpendicular to the longitudinal axis, wherein each section has a different radius of curvature from an adjacent section, said constant curvature sections defining the entire periphery, said periphery interfacing with said pocket, and an ultra hard material layer formed over the cutting element body, the ultra hard material layer having a periphery, wherein the ultra hard material layer periphery comprises at least two constant curvature sections along a second plane generally perpendicular to the longitudinal axis.

18. A bit as recited in claim 17 wherein the cutting element body and the ultra hard material layer peripheries each comprise three constant curvature sections wherein each cutting element body periphery section abuts two adjacent body periphery sections and wherein each of the ultra hard material periphery sections abuts two adjacent ultra hard material periphery sections.

19. A bit as recited in claim 18 wherein abutting sections have different radii of curvature.

20. A bit as recited in claim 19 wherein two sections have the same radius of curvature.

21. A bit as recited in claim 17 wherein the cutting element body and the ultra hard material layer peripheries each consist of two sections, wherein the two cutting element body periphery sections abut each other and wherein the two ultra hard material layer periphery sections abut each other.

22. A bit as recited in claim 17 wherein each ultra hard material periphery section is aligned with a corresponding cutting element body periphery section and wherein corresponding ultra hard material periphery and cutting element body periphery sections have the same radii of curvature.

23. A bit as recited in claim 17 wherein said ultra hard material sections define the entire periphery of the ultra hard material layer.

24. A bit as recited in claim 17 wherein each of said cutting element body and ultra hard material layer peripheries comprise at least two but no more than three constant curvature sections along a plane generally perpendicular to the longitudinal axis.

25. A bit as recited in claim 17 wherein all constant curvature sections of said cutting element ultra hard material have an equal thickness as measured longitudinally along the periphery of said ultra hard material layer.

26. A bit as recited in claim 17 wherein said cutting element periphery has a length and wherein each of said at least two constant curvature sections extend along said entire length.

27. A bit comprising:

a body comprising, a first pocket having a diameter as measured along a plane perpendicular to a longitudinal axis of the first pocket, and a second pocket having a diameter, as measured along a plane perpendicular to a longitudinal axis of the second pocket, that is different from the diameter of the first pocket;

a first cutting element mounted on the first pocket; and a second cutting element mounted on the second pocket, wherein the first cutting element comprises a curved surface having a first curvature along a plane generally perpendicular to a longitudinal axis of the first cutting element for contacting an earth formation during drilling, wherein the second cutting element comprises a curved surface having a second curvature along a plane generally perpendicular to a longitudinal axis of the second cutting element for contacting an earth formation during drilling, wherein the first curvature has a diameter that is the same as the diameter of the second curvature.

28. A bit comprising:

a body comprising, a first pocket having a diameter, and a second pocket having a diameter that is different from the diameter of the first pocket;

a first cutting element mounted on the first pocket, the first cutting element having a body and a cutting layer each having a first diameter portion and a second diameter portion, wherein the second diameter portions have diameters different from the diameters of the first diameter portions, wherein the body first diameter portion is brazed to the first pocket; and a second cutting element mounted on the second pocket, the second cutting element having a body and a cutting layer each having a first diameter portion and a second diameter portion, wherein the second cutting element second diameter portions have diameters different from the diameters of the second cutting element first diameter portions, wherein the second cutting element body first diameter portion is brazed to the second pocket, and wherein the diameter of the second diameter portion of the second cutting element is the same as the diameter of the second diameter portion of the first cutting element.

29. A bit comprising:

a body comprising, a first pocket having a diameter as measured along a plane perpendicular to a longitudinal axis of the first pocket, and a second pocket, as measured along a plane perpendicular to a longitudinal axis of the second pocket, having a diameter that is different from the diameter of the first pocket;

a first cutting element mounted on the first pocket; and a second cutting element mounted on the second pocket, wherein each cutting element comprises a first curved surface for contacting earth formations during drilling and a second curved surface adjacent the first curved surface, wherein the first curved surface of the first cutting element has a first diameter as measured along a first plane perpendicular to a longitudinal axis of the first cutting element, wherein the second cutting element first curved surface has a second diameter as measured along a second plane perpendicular to a longitudinal axis of the second cutting element, wherein the first diameter is different from the second diameter, wherein the first cutting element second curved surface has a curvature having a third diameter as measured along the first plane, wherein the second cutting element second curvature has a fourth diameter as measured along the second plane, wherein the difference between the diameters of the two pockets is different from the difference of the first and second diameters, and wherein the first diameter is not equal to the third diameter and the second diameter is not equal to the fourth diameter.

30. The bit as recited in claim 29 wherein the difference between the diameters of the first and second pockets is greater than the difference between the first and second diameters.

31. The bit as recited in claim 29 wherein the difference between the diameters of the first and second pockets is less than the difference between the first and second diameters.

32. A bit comprising:

a body comprising, a first pocket having a diameter as measured along a plane perpendicular to a longitudinal axis of the first pocket, and a second pocket having a diameter, as measured along a plane perpendicular to a longitudinal axis of the second pocket, that is different from the diameter of the first pocket;

a first cutting element mounted on the first pocket, the first cutting element having a body and a cutting layer each having a first diameter portion and a second diameter portion, wherein each diameter portion of the body is measure along a plane perpendicular to a longitudinal axis of the first cutting element, wherein each diameter portion of the cutting layer is measured along another plane perpendicular to the longitudinal axis of the first cutting element, wherein the second diameter portions have diameters different from the diameters of the first diameter portions, wherein the body first diameter portion is attached to the first pocket; and a second cutting element mounted on the second pocket, the second cutting element having a body and a cutting layer each having a first diameter portion and a second diameter portion, wherein each diameter portion of the second cutting element body is measured along a plane generally perpendicular to a longitudinal axis the second cutting element, wherein each diameter portion of the second cutting element cutting layer is measured along another plane generally perpendicular to the longitudinal axis of the second cutting element, wherein the second cutting element second diameter portions have diameters different from the diameters of the second cutting element first diameter portions, wherein the second cutting element body first diameter portion is attached to the second pocket, and wherein the diameter of the second diameter portion of the second cutting element is different from the diameter of the second diameter portion of the first cutting element.

33. The bit as recited in claim 32 wherein the difference between the diameters of the first and second pockets is greater than the difference between the diameter of the second diameter portion of the second cutting element and the diameter of the second diameter portion of the first cutting element.

34. The bit as recited in claim 32 wherein the difference between the diameters of the first and second pockets is less than the difference between the diameter of the second diameter portion of the second cutting element and the diameter of the second diameter portion of the first cutting element.

35. A bit as recited in claim 32 wherein the first cutting element body first diameter portion is brazed to the first pocket, and the second cutting element body first diameter portion is brazed to the second pocket.

36. A bit comprising:

a body comprising, a first pocket having a diameter, and a second pocket having a diameter that is different from the diameter of the first pocket;

a first cutting element mounted on the first pocket; and a second cutting element mounted on the second pocket, wherein each cutting element comprises a curved surface for contacting earth formations during drilling, wherein the curved surface of the first cutting element has a diameter that is different from a diameter of the curved surface of the second cutting element, wherein the difference between the diameters of the two pockets is different from the difference of the diameters of the two curved surfaces, and wherein the difference between the diameters of the first and second pockets is less than the difference between the diameters of the two curved surfaces.

37. A bit comprising:

a body comprising, a first pocket having a diameter, and a second pocket having a diameter that is different from the diameter of the first pocket;

a first cutting element mounted on the first pocket, the first cutting element having a body and a cutting layer each having a first diameter portion and a second diameter portion, wherein the second diameter portions have diameters different from the diameters of the first diameter portions, wherein the body first diameter portion is brazed to the first pocket; and a second cutting element mounted on the second pocket, the second cutting element having a body and a cutting layer each having a first diameter portion and a second diameter portion, wherein the second cutting element second diameter portions have diameters different from the diameters of the second cutting element first diameter portions, wherein the second cutting element body first diameter portion is brazed to the second pocket, wherein the diameter of the second diameter portion of the second cutting element is different from the diameter of the second diameter portion of the first cutting element and wherein the difference between the diameters of the first and second pockets is less than the difference between the diameter of the second diameter portion of the second cutting element and the diameter of the second diameter portion of the first cutting element.

38. A bit comprising:

a body comprising a first pocket having a first diameter as measured along a plane perpendicular to a longitudinal axis of the first pocket and a second pocket having a second diameter as measured along a plane perpendicular to the longitudinal axis of the second pocket;

a first cutting element mounted in the first pocket, the first cutting element having a first body and a first cutting layer, wherein the first body has a first section having a third diameter as measured along a plane perpendicular to a longitudinal axis of the first body and a second section having a fourth diameter as measured along the plane perpendicular to the longitudinal axis of the first body, wherein the first cutting layer has a first section having a fifth diameter as measured along a plane perpendicular to a longitudinal axis of the first cutting layer and a second section having a sixth diameter as measured along the plane perpendicular to the longitudinal axis of the first cutting layer, wherein the first body first section is attached to the first pocket;

a second cutting element mounted in the second pocket, wherein the second cutting element comprises a second body and a second cutting layer, wherein the second body has a first section having a seventh diameter as measured along a plane perpendicular to a longitudinal axis of the second body and a second section having an eighth diameter as measured along the plane perpendicular to the longitudinal axis of the second body, wherein the second cutting layer has a first section having a ninth diameter as measured along a plane perpendicular to a longitudinal axis of the second cutting layer and a second section having a tenth diameter as measured along the plane perpendicular to the longitudinal axis of the second cutting layer, wherein the second body first section is attached to the second pocket, wherein at least one of said fifth, sixth, ninth and tenth diameters is not equal to another of said fifth, sixth, ninth and tenth diameters, wherein when the first diameter is not equal to the second diameter, the sixth diameter is equal to the tenth diameter, and wherein when the first diameter is equal to the second diameter, the sixth diameter is not equal to the tenth diameter.

39. A bit as recited in claim 38 wherein the first body first section is longitudinally aligned with the first cutting layer first section and wherein the first body second section is longitudinally aligned with the first cutting layer second section and wherein the second body first section is longitudinally aligned with the second cutting layer first section and wherein the second body second section is longitudinally aligned with the second cutting layer second section.

40. A bit as recited in claim 39 wherein the third and fifth diameters are equal, wherein the fourth and sixth diameters are equal, wherein the seventh and ninth diameters are equal, and wherein the eighth and tenth diameters are equal.

41. A bit as recited in claim 38 wherein the first and second cutting layer are ultra hard material cutting layers.

42. A bit as recited in claim 38 wherein the first and second diameters are equal, wherein the sixth and tenth diameters are not equal and wherein the third diameter and the seventh diameter are equal.

43. A bit as recited in claim 42 wherein the third diameter is not equal to the fourth diameter and wherein the seventh diameter is not equal to the eighth diameter.

44. A bit as recited in claim 42 wherein the fifth diameter is not equal to the sixth diameter and wherein the ninth diameter is not equal to the tenth diameter.

45. A bit as recited in claim 38 wherein the first and second diameters are not equal, the sixth and tenth diameters are equal and wherein the third and seventh diameters are not equal.

46. A bit as recited in claim 45 wherein the fourth diameter is not equal to the third diameter and wherein the eighth diameter is not equal to the seventh diameter.

47. A bit as recited in claim 45 wherein the fifth diameter is not equal to the sixth diameter and wherein the ninth diameter is not equal to the tenth diameter.

48. A bit as recited in claim 38 wherein the first cutting layer second section is positioned to make cutting contact with the object being cut by the bit and wherein the second cutting layer second section is positioned to make cutting contact with the object being cut by the bit.

49. A cutting element comprising:

a body comprising a longitudinal axis and a periphery comprising at least two single curvature sections, each section having a single radius of curvature along a plane generally perpendicular to the longitudinal axis, wherein each section has a different radius of curvature from an adjacent section, said single curvature sections defining the entire periphery; and an ultra hard material layer formed over the body, the ultra hard material layer having a periphery, wherein the ultra hard material layer periphery comprises at least two single curvature sections along a plane generally perpendicular to the longitudinal axis, wherein all single curvature sections of said ultra hard material layer have an equal thickness as measured longitudinally along the periphery of said ultra hard material layer.

50. A bit comprising:

a bit body having a pocket; and a cutting element having a longitudinal axis and mounted on the pocket, the cutting element comprising, a cutting element body comprising a periphery comprising at least two single curvature sections along a plane generally perpendicular to the longitudinal axis, wherein each section has a different radius of curvature from an adjacent section, said single curvature sections defining the entire periphery, and an ultra hard material layer formed over the cutting element body, the ultra hard material layer having a periphery, wherein the ultra hard material layer periphery comprises at least two single curvature sections along a plane generally perpendicular to the longitudinal axis, wherein all single curvature sections of said cutting element ultra hard material have an equal thickness as measured longitudinally along the periphery of said ultra hard material layer.

51. A cutting element comprising:

a body comprising a longitudinal axis and an exposed periphery comprising at least two constant curvature sections, each section having a single radius of curvature along a first plane generally perpendicular to the longitudinal axis, wherein each section has a different radius of curvature from an adjacent section, said constant curvature sections defining the entire periphery; and an ultra hard material layer formed over the body, the ultra hard material layer having a periphery, wherein the ultra hard material layer periphery comprises at least two constant curvature sections along a second plane generally perpendicular to the longitudinal axis, wherein all constant curvature sections of said ultra hard material layer have an equal thickness as measured longitudinally along the periphery of said ultra hard material layer.

52. A bit comprising:

a bit body having a pocket; and a cutting element having a longitudinal axis and mounted on the pocket, the cutting element comprising, a cutting element body comprising a periphery comprising at least two constant curvature sections along a first plane generally perpendicular to the longitudinal axis, wherein each section has a different radius of curvature from an adjacent section, said constant curvature sections defining the entire periphery, said periphery interfacing with said pocket, and an ultra hard material layer formed over the cutting element body, the ultra hard material layer having a periphery, wherein the ultra hard material layer periphery comprises at least two constant curvature sections along a second plane generally perpendicular to the longitudinal axis, wherein all constant curvature sections of said cutting element ultra hard material have an equal thickness as measured longitudinally along the periphery of said ultra hard material layer.

* * * * *

UNITED STATES PATENT AND TRADEMARK OFFICE

CERTIFICATE OF CORRECTION

PATENT NO. : 7,461,709 B2
APPLICATION NO. : 10/919906
DATED : December 9, 2008
INVENTOR(S) : Madapusi K. Keshavan It is certified that error appears in the above-identified patent and that said Letters Patent is hereby corrected as shown below:

| | |
|---|---|
| Column 10, line 55, Claim 32 | Delete "measure",<br>Insert --measured-- |
| Column 11, line 1, Claim 32 | After "axis",<br>Insert --of-- |

Signed and Sealed this

Sixth Day of October, 2009

David J. Kappos

David J. Kappos
*Director of the United States Patent and Trademark Office*